US006990885B2

(12) United States Patent
Boyd

(10) Patent No.: US 6,990,885 B2
(45) Date of Patent: Jan. 31, 2006

(54) MISSILE INTERCEPTOR

(76) Inventor: Joseph J. Boyd, 103 Timberland Rd., Cumming, GA (US) 30040-2039

( * ) Notice: Subject to any disclaimer, the term of this patent is extended or adjusted under 35 U.S.C. 154(b) by 0 days.

(21) Appl. No.: 10/881,496

(22) Filed: Jun. 30, 2004

(65) Prior Publication Data

US 2006/0000348 A1 Jan. 5, 2006

(51) Int. Cl.
*B64D 1/04* (2006.01)

(52) U.S. Cl. ..... 89/1.11; 244/3.1; 244/3.15

(58) Field of Classification Search ..... 89/1.11; 244/3.1, 3.15

See application file for complete search history.

(56) References Cited

U.S. PATENT DOCUMENTS 5,112,006 A * 5/1992 Palmer ..... 244/3.16
6,209,820 B1 * 4/2001 Golan et al. ..... 244/3.15

OTHER PUBLICATIONS

Modern Air Combat, Gunston and Spick, Crescent Books, 1983, pp. 200-2001.*

Russian Aviation Page: Sukhoi Su-35 fighter, http://aeroweb.lucia.it/~agrtech/RAFAQ/Su-35.html, Jul. 17, 1997.*

Russian Aviation Page: Rearward firing missile, http://aeroweb.lucia.it/~agretch/RCAQ/R-73.html, Jul. 11, 1997.*

Air Power Australia, http://www.ausairpower.net/API-ASRAAM-Analysis.html, 1998.*

* cited by examiner

*Primary Examiner*—J. Woodrow Eldred
(74) *Attorney, Agent, or Firm*—Troutman Sanders LLP; Ryan A. Schneider

(57) ABSTRACT

The present invention is a method of interception. When a missile is launched and detected by a satellite, an anti-missile rocket is launched to intercept it. When the anti-missile rocket nears the point of interception, it goes into a turn of about 180 degrees, to reverse its course, and comes in behind the enemy missile, at a speed almost equal to that of the ICBM. In this maneuver, coming in behind the ICBM, it reduces the relative speed of the two rockets from about 13,000 mph to about 50 mph, and allows the interceptor missile to approach the ICBM at a slow speed and easily destroy it.

9 Claims, 3 Drawing Sheets

MISSILE INTERCEPTOR

BACKGROUND OF THE INVENTION

1. Field of the Invention

The present invention generally is a means for intercepting and destroying intercontinental, cruise and shorter range missiles.

2. Description of the Related Art

A great danger to America from an enemy nation is the intercontinental ballistic missile (ICBM). If these missiles carry nuclear warheads, and are able to penetrate our defense system, they can destroy city after city with but little effort on the enemies' part. These missiles are very effective and efficient. They are ballistic in that they are guided and propelled during the initial phase of the flight, and follow a free-falling ballistic trajectory towards the target under the influence of gravity the remainder of the distance. Initially, they are propelled high above the atmosphere by rockets and may divide into many separate warheads that are freely moving missiles on their own and that are destined for different targets.

Our present system for protecting this nation during an enemy ICBM missile attack is based on the ability of our anti-ballistic missiles to be launched from their silos, to rise high above the earth, to go far out to sea, and hit the incoming ICBM missile, head on. The enemy missile might be spotted 5,000 miles away and moving at 15,000 mph, and our anti-missile rocket is set on a trajectory that is calculated to intercept it.

If the two trajectories exactly match, the missiles collide, or if the trajectories cross and the two missiles reach the point of intersection at the same time, they collide. Yet, the missiles may have a difference in speed of 30,000 mph, and thus the slightest error in the trajectory or the timing can cause the missiles to miss colliding by a number of miles.

Because of this, our ballistic missile defense (BMD) is based on a system having several independent layers, giving us the opportunity to destroy the missiles at multiple points on the trajectory. Our defense starts off early in the trajectory when high-energy lasers, directed from satellites, are used to destroy the enemy boosters. Thereafter, the anti-ballistic missiles try to pick off the incoming ICBM's and our anti-satellite missiles protect the satellites from the ground missiles. If a large number of missiles have been launched, some enemy missiles will get through the first layers. They are still vulnerable to our late launched anti-ballistic missiles clear down to the time they reach the reentry stage. Even if missed more than once, additional opportunities are provided to take out the enemy missiles with each succeeding layer. The system works, but it has problems and requires a large number of anti-ballistic missiles to be on ready.

The greatest problem with the front interceptor system is the great difference in relative speed between the interceptor and the missile. This difference in speed is astronomically high. If the ICBM is moving at 15,000 mph and the interceptor is moving at 15,000 mph, the difference in speed can be as high as 30,000 mph. In just one second, the missiles move 4.6 miles closer to, or further away from, each other, as the case might be, and the slightest deviation in direction or speed of the interceptor becomes highly magnified. At the last second, correction is impossible. This has been likened to trying to hit a bullet with a bullet, and it is to the engineers' credit that they can intercept any of these missiles by this method.

It is the intent of the present invention that the problem of "hitting a bullet with a bullet" is eliminated, and that our future anti-ballistic missiles will not only kill its intended missile, but that it will seek out and destroy other enemy missiles as well.

BRIEF SUMMARY OF THE INVENTION

Briefly described in its preferred form the present invention is a very effective combination of two missile programs. The first system is the frontal attack on the enemy missile. In this system, the ready detection system would be the same, the anti ballistic missiles would be the same with minor variations, the silos and launch systems would be the same, and the interceptor would start as if we are making a frontal attack on the ICBM. All of this is old to the art, and is well developed.

The other system, the rear attack method, where a missile overtakes the enemy missile or airplane from behind is old to the art, also. Many of those missiles are heat seeking.

A novel and nonobvious aspect of the present invention is that the interceptor missile approaches from the front, and as it nears the oncoming ICBM, it launches a number of smaller heat seeking missiles behind the enemy missiles, which overtake and destroy the ICBMs.

A variation of this method is where the interceptor, when it reaches the enemy missiles, makes a half loop to approach the ICBM from the rear, and moving only a little faster than the ICBM, overtakes it and destroys it.

These methods are a complete change of values where the one shot deal of "one bullet hitting another", is replaced by a slow, absolute kill as the interceptor overtakes the ICBM from the rear. Since the anti-missiles are still in the area of other missiles, they can systematically seek them out and destroy them.

These and other objects, features and advantages of the present invention will become more apparent upon reading the following specification in conjunction with the accompanying drawings.

DETAILED DESCRIPTION OF THE PREFERRED EMBODIMENTS

Figure 1:
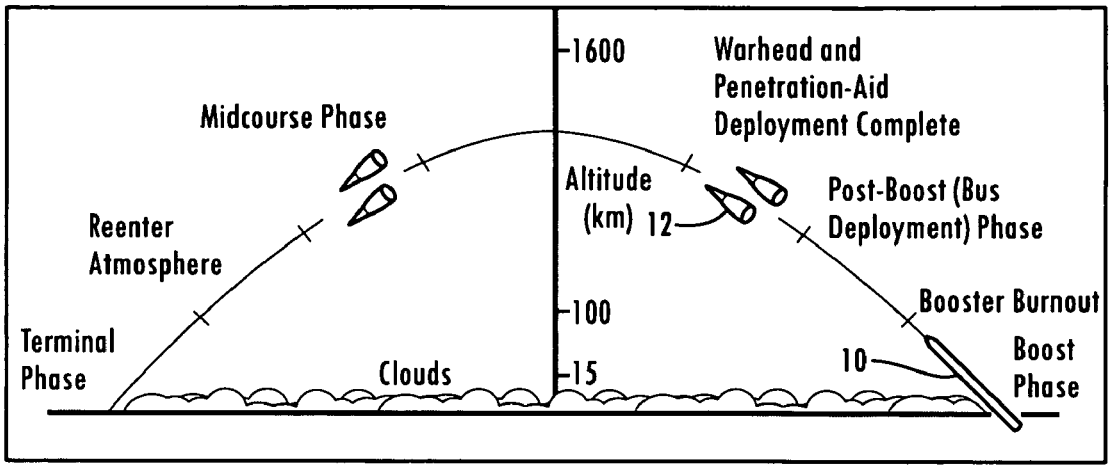
Fig. 1 (PRIOR ART)
FIG. 1 illustrates the phases of conventional ballistic missile trajectories.

Referring now in detail to the drawing figures, wherein like reference numerals represent like parts throughout the several views, FIG. 1 illustrates the phases of a typical enemy ballistic missile trajectory. In the boost phase, the enemy launches a rocket driven first flying device, or missile 10, and its payload up above the atmosphere. The post-boost phase occurs next, where the multiple warheads 12 and penetration aids are released from the boost missile. Next, during the mid-course phase, the missiles travel a long distance on trajectories above the atmosphere, and on the terminal phase, they reenter the atmosphere to zero in on their targets.

Figure 2:
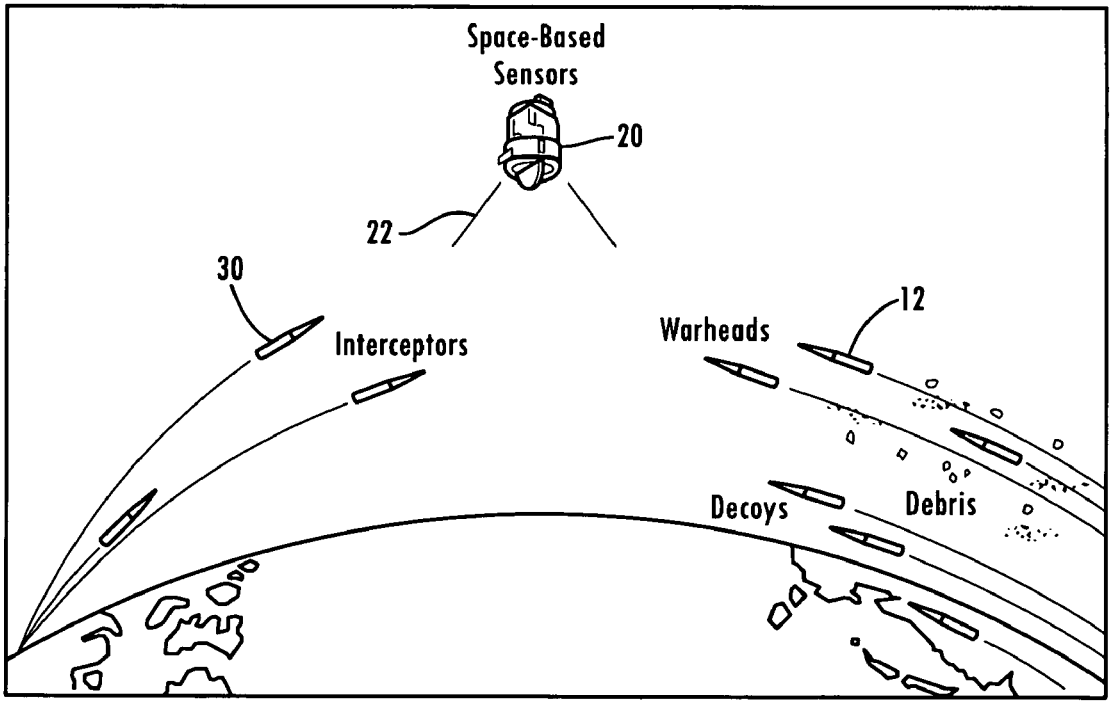
Fig. 2 (PRIOR ART)
FIG. 2 shows the conventional response to the attack of FIG. 1.

FIG. 2 shows our conventional response to the threat of the enemies ICBM. The space-based sensors 20 first warn of the attack, and then continuously track all objects from launch to the end, and they also use high energy lasers 22 to destroy the booster and the post-boost missiles. In the mid-course flight, if the interceptors are on course when they reach the warheads 12, they hit head on and destroy them. If some miss, we have opportunities later to intercept and destroy the enemy missiles with additional interceptors, throughout the distance, even after they have reentered the atmosphere.

Figure 3:
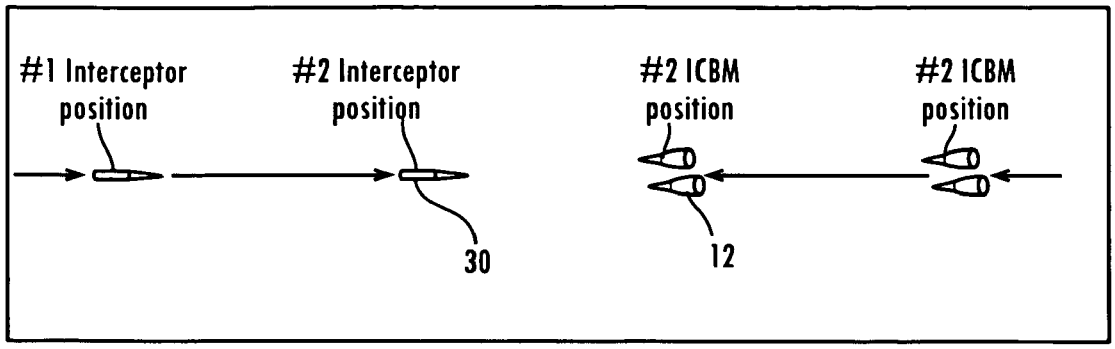
Fig. 3 (PRIOR ART)
FIG. 3 shows a relative approach between a ballistic warheads and an interceptor.

FIG. 3 shows the enemy ballistic warheads 12 moving in at high speed, and a second flying device, or interceptor 30, approaching on the same general trajectory. Two positions of the missiles are shown.

Figure 4:
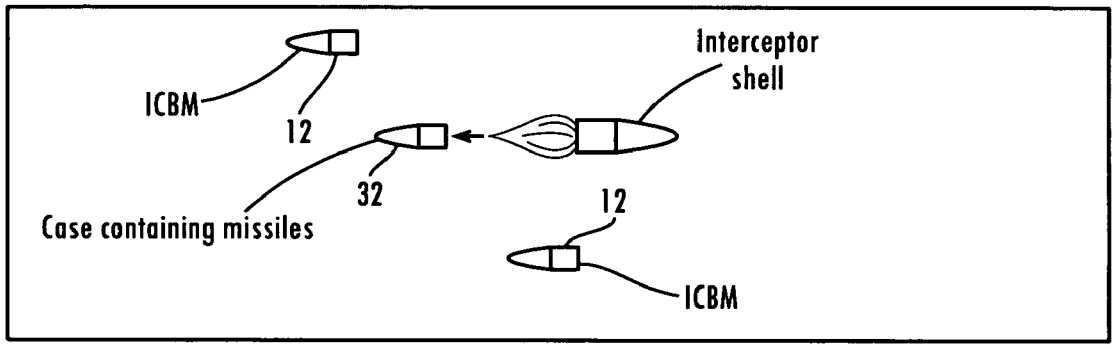
FIG. 4 is a preferred embodiment of the present invention showing an interceptor missile as it passes an ICBM warhead. A case containing the small killer missiles is fired backward at a speed approximately equal to that of the ICBM's.

FIG. 4 is a plan view showing the interceptor missile 30 as it passes the ICBM warheads 12. At this time, the interceptor blasts a small case 32 of guided elements, or heat seeking missiles 34, straight back at a speed close to the speed of the enemy warheads 12.

Figure 5:
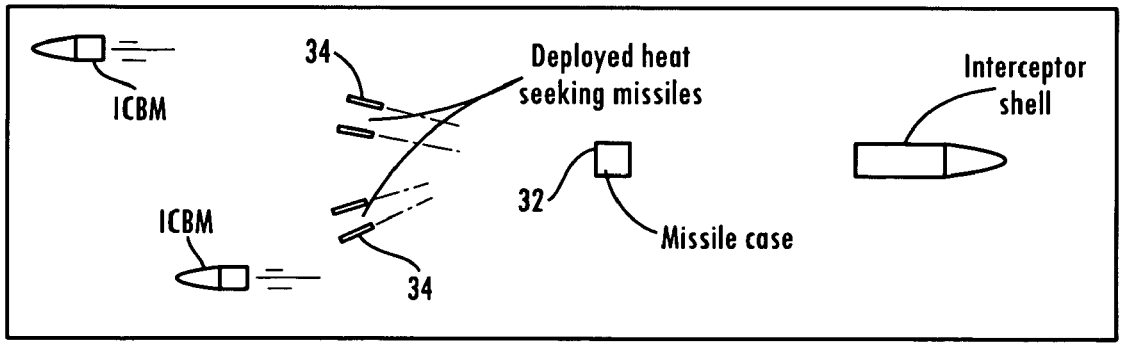
FIG. 5 is a preferred embodiment of the present invention showing small missiles released from their case, and spreading out as they start to seek out the warheads and destroy them.

FIG. 5 shows these small missiles 34 released from their case 32 and spreading out as they start to seek out the warheads 12 and destroy them.

Figure 6:
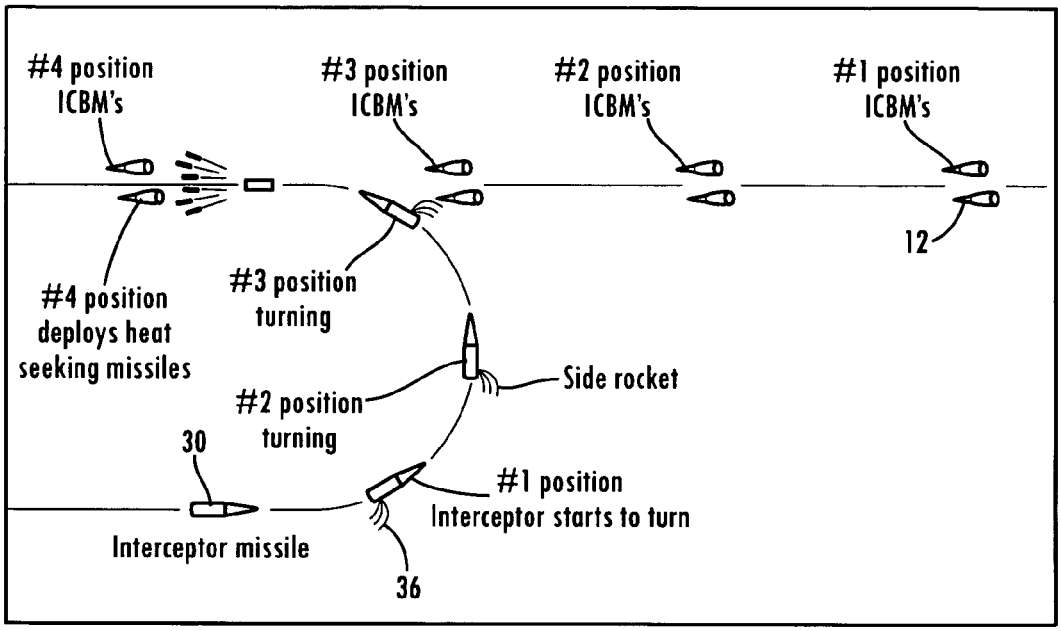
FIG. 6 is a preferred embodiment of the present invention showing the interceptor missile with a side rocket.

FIG. 6 is a view of the interceptor missile 30, with a side rocket 36 that forces the missile into a 180 degree turn, while moving at full speed. This puts the interceptor 30 in behind the enemy warheads 12 and moving at about the same speed. The cluster of heat seeking missiles is then released, and they quickly overtake the warheads and destroy them.

With the preferred embodiments of the present invention include missiles 30 and warheads 12, it will be understood by those in the art that the present invention comprehends the interception of an enemy missile by an anti-ballistic inceptor. Enemy missiles can include ICBMs, cruise missiles and other high speed missiles.

A preferred method of operation of the present system is that when the interceptor reaches the ICBM, on the anticipated ICBM trajectory, that it is programmed to separate from the case of heat seeking missiles, and to blast them back at high speed towards the ICBMs. The small missiles have their own rockets, which allow them to seek out the ICBMs, overtake them, and destroy them. The back of the interceptor missile can be cylindrical with the case of heat seeking missiles inside like a bullet in the barrel of a gun, and the powder charge sufficient to bring the small missiles up to the speed of the ICBMs.

This would greatly simplify the programming. The interceptor's trajectory would be set to match the anticipated trajectory of the ICBM as close as possible, and when the interceptor reached the ICBM, it would automatically fire the small missiles straight back, and its empty shell would continue. In this case, the interceptor could be spinning to help keep its orientation.

Another preferred method of operation of the present system has the heat seeking missiles in the nose of the interceptor missile. The preferred method in this case is to fire the interceptor missile on a trajectory a fixed distance from the ICBM trajectory, and parallel to it. The trajectory of the interceptor missile may be above, below, or to one side of the trajectory of the ICBM.

At a predetermined distance from the oncoming ICBM, the interceptor makes an abrupt turn of about 180 degrees, reversing its direction, to come in behind the ICBM on the ICBM's trajectory. A sudden burst of power enables the interceptor to overtake the ICBM, and at this point, the interceptor can deploy a number of missiles, guided by a heat sensor or by radar to close directly on the ICBM. Since the relative speed can be little more than 50 mph, instead of 30,000 mph, the ICBM will be an easy kill.

In this system, we trade off the almost impossible need of hitting a bullet with a bullet, for a proven system of turning the anti-ballistic missile 180 degrees in full flight to come in behind the ICBM at almost the same speed, and the easy kill of shooting down the ICBM at this low speed, instead of trying to hit it at 30,000 mph. With the interceptor moving a short distance behind the ICBM and at a little higher speed, it would be like shooting ducks in a barrel, and this system would probably be very effective.

To make the 180 degree turn, the anti-ballistic missile would need side rockets. If the forces of these rockets are applied at right angle to the direction of motion, the actual velocity of the rocket would change but little during the turn.

The speed and the design of the interceptor, and the power of the side rocket, would determine the turning radius, and therefore, the distance between the trajectory of the interceptor and that of the ICBM.

Even if the enemy changed the trajectory of the ICBM, the interceptor would have no problem in shooting it down. And with a high kill rate with our interceptors, it would make the ICBM obsolete.

Numerous characteristics and advantages have been set forth in the foregoing description, together with details of structure and function. While the invention has been disclosed in its preferred form, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A process of interception between a first flying device and a second flying device comprising the steps of:

detecting the trajectory of the first flying device;

initiating the flight of the second flying device, wherein the second flying device is sent on a trajectory of generally intercepting the first flying device;

separating from the second flying device guided elements upon the second flying device passing the first flying device, wherein the second flying device does not intercept the first flying device, and wherein the guided elements are sent on a trajectory approximately opposite the trajectory of the second flying device, and on a trajectory approximately the same as the trajectory of the first flying device; and intercepting the first flying device with at least one guided element;

wherein the first flying device is an ICBM.

2. The process of interception according to claim 1, wherein the second flying device is an anti-ballistic missile.

3. The process of interception according to claim 1, wherein the step of detecting the trajectory of the first flying device comprises using a spaced-based detection device.

4. The process of interception according to claim 1, wherein the guided elements comprise heat seeking missiles.

5. The process of interception according to claim 1, wherein the guided elements comprise radar guided missiles.

6. A process of missile in interception, where an enemy incoming missile is detected and an interceptor missile is launched to meet it and to destroy it, wherein as the interceptor missile passes the enemy missile, the interceptor missile separates and shoots a number of small rocket driven missiles straight back along the trajectory of the enemy missiles, so that the relative speed of the small rocket driven missiles and the enemy missiles is now the difference in their total speeds, and not the sum of their total speeds as with the frontal approach, and this allows the small missiles to maneuver easily into position to destroy the enemy missile.

7. The process of missile interception of claim 6, where the enemy missile is an ICBM.

8. The process of missile interception of claim 6, where the enemy missile is a cruise missile.

9. The process of missile interception of claim 6, where the interceptor missile is an anti-ballistic missile, having a cylindrical rear section, containing a number of small rocket driven missiles, which are ejected at high speed in the reverse direction by a charge, so that they can overtake and destroy the enemy missile.

* * * * *